US011306945B2

(12) United States Patent
Hackl et al.

(10) Patent No.: US 11,306,945 B2
(45) Date of Patent: Apr. 19, 2022

(54) HEATING SYSTEM FOR HEATING A FLUID MEDIUM

(71) Applicant: Bleckmann GmbH & Co. KG, Lamprechtshausen (AT)

(72) Inventors: Heinz Frederic Hackl, Mattsee (AT); Jürgen Winkler, Seeham (AT)

(73) Assignee: Bleckmann GmbH & Co. KG, Lamprechtshausen (AT)

( * ) Notice: Subject to any disclaimer, the term of this patent is extended or adjusted under 35 U.S.C. 154(b) by 271 days.

(21) Appl. No.: 16/563,421

(22) Filed: Sep. 6, 2019

(65) Prior Publication Data

US 2020/0080749 A1 Mar. 12, 2020

(30) Foreign Application Priority Data

Sep. 7, 2018 (EP) ..... 18193209

(51) Int. Cl.
*F24H 9/18* (2006.01)
*F24H 1/00* (2006.01)
(Continued)

(52) U.S. Cl.
CPC ..... *F24H 9/1818* (2013.01); *F24H 1/0018* (2013.01); *F24H 1/08* (2013.01);
(Continued)

(58) Field of Classification Search
None
See application file for complete search history.

(56) References Cited

U.S. PATENT DOCUMENTS 1,418,011 A * 5/1922 Mehn ..... F24H 1/162 392/479
1,838,680 A * 12/1931 Hudson ..... H05B 3/28 392/481
(Continued)

FOREIGN PATENT DOCUMENTS

CN 1656277 A 8/2005
CN 102529640 A 7/2012
(Continued)

OTHER PUBLICATIONS

EPO; Application No. 18193209.6; Extended European Search Report dated Feb. 8, 2019.
(Continued)

*Primary Examiner* — Thor S Campbell
(74) *Attorney, Agent, or Firm* — Fitch, Even, Tabin & Flannery LLP

(57) ABSTRACT

The present invention relates to a heating system for heating a fluid medium, said heating system comprises a carrier unit and a heating unit, with the carrier unit having a surface comprising at least a plane portion being at least substantially normal to a longitudinal axis and an at least part-circularly shaped groove extending from said carrier unit and wound about the longitudinal axis, and the heating unit having a heating element at least partially arranged in said groove of said carrier unit. In the inventive heating system, the groove extends at least partially helically about the longitudinal axis. The present invention further relates to a heated conveyor pump for conveying and heating a fluid medium, said pump comprises a drive unit, a pump housing and the inventive heating system. The heating system is coupled to the pump housing with the groove extending into the pump housing in a manner such that the size of the cross-section of the groove decreases in the flow direction of the conveyed fluid medium.

16 Claims, 9 Drawing Sheets

(51) Int. Cl.
*F24H 1/08* (2006.01)
*F24H 1/10* (2006.01)
*F24H 9/00* (2006.01)
*F24H 9/1818* (2022.01)

(52) U.S. Cl.
CPC ..... *F24H 1/102* (2013.01); *F24H 9/0047* (2013.01); *F24H 2250/02* (2013.01)

(56) References Cited

U.S. PATENT DOCUMENTS 2,420,175 A * 5/1947 Johnstone ..... F24H 1/162 392/481
3,782,456 A * 1/1974 Gusmer ..... F28D 7/0041 165/164
4,255,646 A * 3/1981 Dragoy ..... F17C 7/04 137/341
4,356,381 A * 10/1982 Flaherty, Jr. ..... A47J 31/545 219/526
4,460,819 A * 7/1984 Eugster ..... F24H 1/142 392/467
4,558,205 A * 12/1985 Bleckmann ..... H05B 1/0269 392/467
4,778,977 A * 10/1988 Bleckman ..... A47J 31/542 138/115
4,825,042 A * 4/1989 Hauslein ..... A47J 31/545 392/467
4,992,690 A * 2/1991 Baker ..... F04D 13/06 310/89
5,156,524 A * 10/1992 Forni ..... F04D 29/441 415/182.1
5,701,388 A * 12/1997 Steinhardt ..... A61H 33/0095 392/471
6,442,341 B1 * 8/2002 Wu ..... A47J 31/542 392/479
6,779,974 B2 * 8/2004 Chien ..... F01D 1/02 415/206
7,293,958 B2 * 11/2007 Kraffzik ..... F04D 29/588 415/206
7,455,065 B2 * 11/2008 Schrott ..... F04D 29/426 134/56 D
7,538,301 B2 * 5/2009 Teufl ..... H05B 3/44 219/523
7,560,672 B2 * 7/2009 Pleschinger ..... F24H 9/2028 219/545
8,989,566 B2 * 3/2015 Liu ..... F04D 13/06 392/471
9,297,553 B2 * 3/2016 Vallejo Noriega ... F24H 9/2028
9,371,841 B2 * 6/2016 Verma ..... F04D 29/406
9,631,835 B2 * 4/2017 De Mango ..... A47J 31/542
10,213,085 B2 * 2/2019 Vallejo Noriega ..... A47L 15/4225
10,641,521 B2 * 5/2020 Wedam ..... B22D 17/24
10,724,547 B2 * 7/2020 Zoppas ..... A47L 15/4285
2004/0026411 A1 * 2/2004 Mucke ..... H05B 3/26 219/543
2007/0012685 A1 * 1/2007 Gourand ..... H05B 3/22 219/628
2007/0228032 A1 * 10/2007 Reiter ..... F24H 9/20 219/543
2008/0283094 A1 * 11/2008 Nagel ..... A47L 15/4285 134/10
2010/0119360 A1 * 5/2010 Bredl ..... F04D 29/588 415/178
2010/0126534 A1 * 5/2010 Busing ..... F04D 29/4293 134/105
2012/0087642 A1 4/2012 Bohlender et al.
2013/0055902 A1 * 3/2013 Berto ..... A47J 31/542 99/281
2013/0202279 A1 * 8/2013 Reichl ..... F24H 1/142 392/480
2015/0168010 A1 6/2015 Jansen et al.
2016/0109152 A1 * 4/2016 Teufl ..... A47J 27/21083 392/318
2017/0188779 A1 7/2017 Lee
2019/0335540 A1 * 10/2019 Hofer ..... F22B 35/18
2021/0145208 A1 * 5/2021 Zhang ..... F24H 9/0015

FOREIGN PATENT DOCUMENTS

CN 104428604 A 3/2015
DE 19858137 A1 6/2000
DE 19916136 A1 10/2000
DE 202008015058 U1 2/2009
EP 1233649 B1 8/2005
EP 1507914 B1 12/2006
EP 2960595 A1 12/2015
KR 100817266 B1 3/2008
WO 92/05675 A1 4/1992

OTHER PUBLICATIONS

CNIPA; Application No. 201910830842.2.; Office Action dated Oct. 25, 2021.

* cited by examiner

Fig. 4
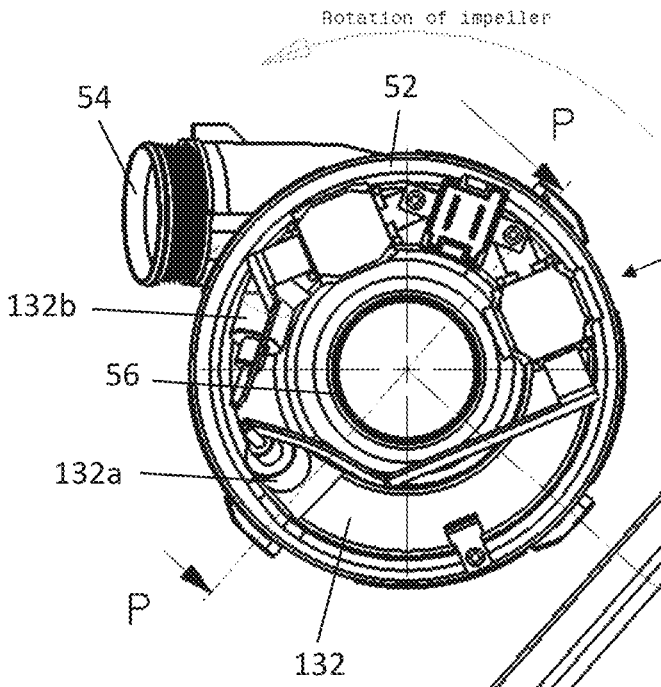
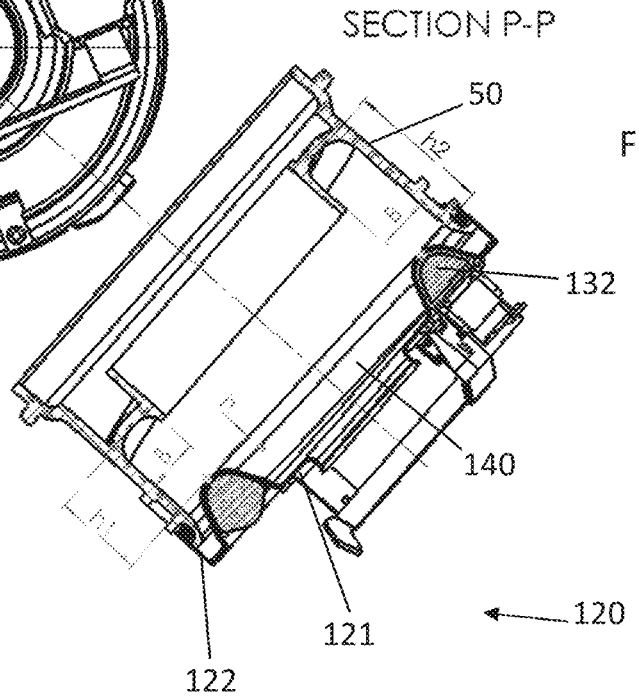
Fig. 4a

Section F-F

HEATING SYSTEM FOR HEATING A FLUID MEDIUM

CROSS-REFERENCE TO RELATED APPLICATION

The present application claims the benefit of priority of European Patent Application No. 18193209.6 filed on Sep. 7, 2018, the content of which is incorporated herein by reference in its entirety.

FIELD OF THE INVENTION

The present invention relates to a heating system for heating a fluid medium, wherein the heating system comprises a disk-like carrier unit and a heating unit. The carrier unit has a central axis, a groove extending at least partially around the central axis, and a bottom. The heating unit has a heating element at least partially arranged in said groove of said carrier unit. The present invention further relates to a heated conveyor pump for conveying and heating a fluid medium, said pump comprising a drive unit, a pump housing and a heating system for heating a fluid medium.

BACKGROUND OF THE INVENTION

In many types of domestic appliances or domestic machines, it is necessary to heat up a fluid medium, such as for example water. For heating up said fluid, various heating systems are known.

From PCT patent application WO 92/05675, a heating device is known, which has a tubular heating element that extends into the fluid to be heated.

In EP patent 1 233 649, a heating system is disclosed that has a circular shaped heating element arranged at one side of a heat conducting plate, and in which the medium to be heated is in contact with the respective other side of the heat conducting plate.

A conveyor pump disclosed in DE patent application 199 16 136 has a heating element arranged at the inlet portion of the pump housing. The heating element has a rectangular cross-section, and is arranged at the outside of the pump housing such that it contacts the pump housing for heat transfer with two of its four side surfaces.

EP patent 1 507 914 discloses a conveyor pump with a heating element of a rectangular cross-section that is approximately completely arranged in a corresponding groove which extends into the pump housing. The heating element has two cranked ends that extend from the groove for being connected to a power source.

In the known heating systems, the contact surface of the heating element with the heat conducting carrier element, and thus, the heat transferring area, is small in relation to the overall surface of the heating element, or the heating element has a shape that is critical regarding thermal spots, particularly in the region of the cranked ends.

SUMMARY OF THE INVENTION

Thus, it is an object of the present invention to provide a heating system and a heated conveyor pump with which the above drawbacks may be overcome, and which allows an optimized heating and conveying of a fluid medium.

According to the present invention, there is provided a heating system for heating a fluid medium. Said heating system comprises a carrier unit and a heating unit, wherein the carrier unit has a central axis, a groove extending at least partially around the central axis and a bottom, and the heating unit has a heating element at least partially arranged in said groove of said carrier unit. In the inventive heating system, at least a section of the bottom of the groove or the groove bottom, respectively, is inclined with an inclination angle >0°.

The inclination can be referred to a virtual or real plane of the carrier unit extending at least substantially normal to the central axis of the carrier unit and encompassing the bottom of the groove. In other words, the at least one section or portion of the groove bottom has a slope or inclination, respectively, with respect to the virtual or real plane extending at least substantially normal to the central axis of the carrier unit and encompassing the groove bottom.

This design allows an optimization of the flow conditions in a pump or conveyor pump, respectively, in which the inventive heating system is used. Thus, an optimized hydraulic efficiency may be reached. Thereby, the inclination angle can range from a value larger than 0° up to a maximum value of 90°. In the latter case, the at least one section of the groove bottom forms a step. Moreover, it is possible that the at least one section of the groove bottom having an inclination angle larger than 0° starts from a plane section of the bottom groove being at least substantially normal to the central axis, so that a kink or sharp bend is formed. Such a step or kink produces turbulences in the flow of the medium to be heated which also increases efficiency.

As already mentioned, it is not necessary that the carrier unit has a physical plane or plane portion normal or perpendicular to the central axis of the carrier unit. The plane or plane portion can also be virtual, for example when the carrier unit is designed as a ring and the plane is defined by the inner circle of the ring. The central axis is preferably a central longitudinal axis of the carrier unit.

The groove can extend in different ways around the central axis of the carrier unit. In a preferred embodiment of the inventive heating system, the groove has an at least part-circularly shape. Moreover, its cross-section can have a circular-shaped, quadrangular-shaped, trapezoidal-shaped, bell-shaped, V-shaped design or any other possible design.

In a preferred embodiment of the inventive heating system, a gradient of the inclination of the groove bottom is at least partially continuous or steady, respectively, and/or at least partially discontinuous or unsteady, respectively. In the latter case, the groove bottom or inclination can form a kink or sharp bend, respectively. The gradient of the inclination of the groove bottom can be within a plane surface that forms the groove bottom, or the deepest line of a groove bottom with an arcuate cross-section.

In a further preferred embodiment of the inventive heating system, the groove bottom can have at least two sections the inclination angles of which are unequal and/or at least two sections the inclination angles of which are equal. Here, the sections can follow one after the other or can be separated from each other. Thus, it is possible that the groove bottom can have two or more sections being separated from each other in the circumferential direction of the disk-like carrier unit around the central axis wherein these two or more sections can have equal inclination angles or unequal inclination angles. It is also possible that the groove bottom can have two or more sections following one after the other in the circumferential direction of the disk-like carrier unit around the central axis wherein these two or more sections can have equal inclination angles or unequal inclination angles. A combination of these designs is also possible.

Preferably, the groove bottom can extend at least partially helically around the central axis. The helical extension of the groove bottom that can, for example, extend into a pump housing of a heated pump allows an optimization of the flow conditions in the pump, and thus, an optimized hydraulic efficiency may be reached.

In a preferred embodiment of the inventive heating system, the heating element of the heating unit has at least partially a helical shape. The helically shaped heating element can thus match the shape of the groove and provides an optimized heat transfer from the heating element to the carrier unit and thus to the medium to be heated.

In a further preferred embodiment of the inventive heating element, the heating element can be an at least partially part-circularly shaped tubular heating element. Preferably, the heating element can have at least one cranked or offset end. The degree of offsetting can be made with different radii along the central longitudinal axis of the heating element. Due to the specific design of the groove in the carrier unit, the heating element may only need to be provided with one cranked end, whereas the respective other end may be left straight or only slightly curved. The non-cranked end may be selected as the filling end of the tubular heating element during its production. Furthermore, the cranked end of a heating element is a critical portion regarding possible hot spots. By omitting one cranked end, the quality and durability of such heating elements may be increased.

Moreover, the heating element can have two cranked ends wherein the degree of offsetting of the cranked ends can preferably be different. This design allows optimum adaptation to the design conditions of a pump in which the heating system according to the invention is to be used.

It is further preferred that an inwards direction is defined as the extension direction of the groove from the carrier unit projected onto the central axis, and the at least partially part-circularly shaped tubular heating element is arranged in the groove with the at least one cranked end positioned at the largest extension of the groove in the inwards direction. In this configuration, the cooling of the cranked end, which is a possible hot spot, may be improved due to the large extension length into the pump housing.

It is further preferred that a size of the cross-section of the groove continuously decreases at least partially, wherein the at least partially part-circularly shaped tubular heating element is arranged in the groove with the at least one cranked end positioned at least approximately at the largest cross-section of the groove. In this configuration, the cooling of the cranked end, which may be a possible hot spot, is improved, and the durability of the heating element may further be increased.

The coupling between the heating element and the carrier unit may be realized in different ways. In an advantageous configuration, the heating element is coupled to the carrier unit by a joining process.

A joining process may include welding, soldering or gluing. Using these joining technologies provide a safe connection between the heating element and the carrier unit. Particularly, by using soldering or gluing technologies, additional material may be inserted into a possible gap between the heating element and the carrier unit, whereby the heat transfer from the heating element to the carrier unit may be optimized. With regard to a gluing process, it has to be noted that the glue used should have specific features regarding thermal stability and heat conductivity.

The connection or joining between the heating element and the groove in the disk-shaped carrier unit should be designed in such a way that, viewed in cross-section, at least 50% of the outer circumference of the heating element is in planar contact with the boundary surface of the groove, preferably this contact should be >50%. Defects, such as air inclusions, which can form between the outer circumferential surface of the heating element in the groove and the boundary surface of the groove during a, for example, soldering process are not taken into account.

For transferring a uniform heat output over the entire length of the heating element, the size of the cross-section of the heating element may be at least approximately constant.

However, it is also possible that the heating element has portions with cross-sections of different sizes. In one embodiment, the end portion of the heating element may have a larger cross-section than the remaining portion. It is also possible that the heating element is provided with more than two sections having different sized cross-sections. These designs allow to provide a heating element with zones of different heat output, e.g. in adaption to specific applications.

Alternatively, or additionally, it may be of advantage that the size of the cross-section of the heating element decreases at least approximately continuously, at least partially. These sections may thereby provide a continuously increasing or decreasing heat output.

The cross-section of the heating element may have any suitable shape. In one embodiment the heating element has a circular cross-section. The production of heating elements with circular cross-section requires low production complexity.

Naturally, the heating element may have a non-circular cross-section, like a triangular, rectangular or oval cross-section. The cross-section of a heating element may be selected in adaption to the specific application, or to reach a maximum contact area between the heating element and the carrier unit in the specific application.

For controlling the heating system, and for protecting the heating element from being destroyed, it may further be of advantage that at least one safety device may be arranged at the surface of the heating element that faces away from the carrier unit. In a simple case, the safety device may be a temperature sensor for detecting the temperature of the heating element, like an NTC thermistor or an electromechanical switching unit. Upon detection of an unintended high temperature, a safety shutdown may be executed, or the heating element may be controlled such that the temperature decreases, e.g. by reducing the current supply.

In order to increase the safety and control options, a further safety device may be arranged at the surface of the heating element that faces away from the carrier unit, and with a distance thereto. The further safety device may be arranged such that it is not in direct contact with the heating element, but in a predefined distance thereto. The distance and the position of the further safety device may be selected such that the maximum temperature of the medium to be heated can be limited, and that the heating element is thermally protected against overheating without activating a thermal fuse. Also the second safety device may be realized as a temperature sensor, like an NTC thermistor or electromechanical switching unit.

Further according to the present invention, the carrier unit may be provided with a protective coating, at least at that surface facing away from the heating element, i.e. the surface that may come in contact with the medium to be heated. Such a coating may protect the carrier unit against corrosion or other impact of a possible aggressive medium. The protective coating can be made of an inorganic material, a sol-gel material, a glass-like material etc.

In order to reach an optimal heat transfer from the heating element to the medium to be heated, it is of advantage that the carrier unit may comprise or consist of a material having an optimal heat conductivity, like aluminium or an aluminium alloy. However, dependent on the medium to be heated or the maximum temperature of the heating element, other materials may be selected, like stainless steel.

Moreover, there is provided a heated conveyor pump for conveying and heating a fluid medium. Said pump comprises a drive unit, a pump housing and a heating system according to the present invention. In the inventive heated conveyor pump, the heating system can be coupled to the pump housing with the groove extending into the pump housing in a manner such that the size of the cross-section of the groove preferably decreases continuously or discontinuously in the flow direction of the conveyed fluid medium. Due to the specific shape of the groove, the hydraulic efficiency of the conveyor pump may be increased and/or optimized.

Further advantages and preferred embodiments of the present invention will be described in the following together with the drawings listed below. The expressions "left", "right", "below" and "above" used in the following description are referred to the drawings in an alignment such that the reference numbers and the notation of the figures used can be read in normal orientation.

BRIEF DESCRIPTION OF THE DRAWINGS

FIG. 4: is a plan view to the heating system according to FIG. 3, including the pump housing;

FIG. 4*a*: is a sectional view along line P-P in FIG. 4;

DETAILED DESCRIPTION

Figure 1:
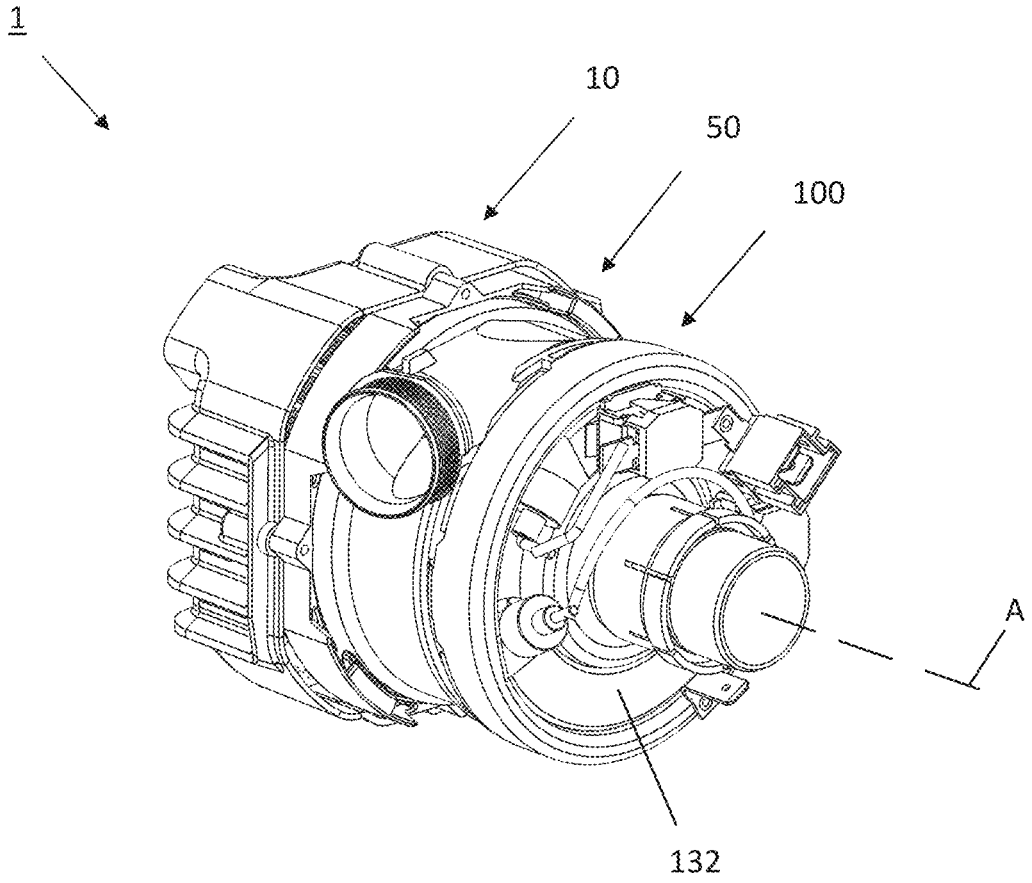
FIG. 1: is a perspective view to a heated conveyor pump according to the present invention.

FIG. 1 shows a heated conveyor pump 1 according to the present invention. Heated conveyor pump 1 includes a drive unit 10, like an electric motor, a pump housing 50 and a heating system 100, which are arranged coaxially along a common central longitudinal axis A.

Figure 1A:
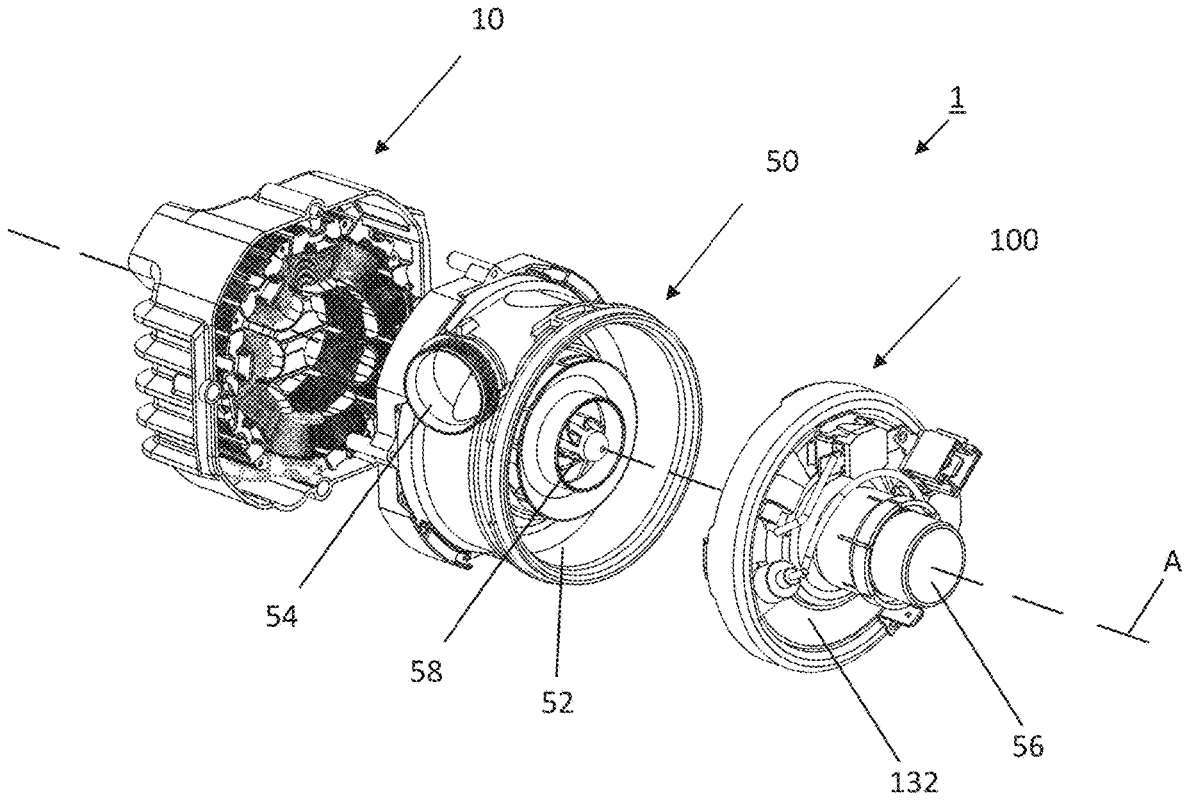
FIG. 1*a*: is an exploded view to the heated conveyor pump according to FIG. 1.

As can be seen in FIG. 1*a*, pump housing 50 has a cylindrical wall 52 with an inlet opening facing towards heating system 100, and an outlet branch 54 extending radially from cylindrical wall 52. The inlet opening is covered by heating system 100. Heating system 100 has a central through hole which forms an inlet branch 56. In pump housing 50, a pump wheel 58 is arranged for conveying the fluid medium from inlet branch 56 to outlet branch 54.

Figure 2:
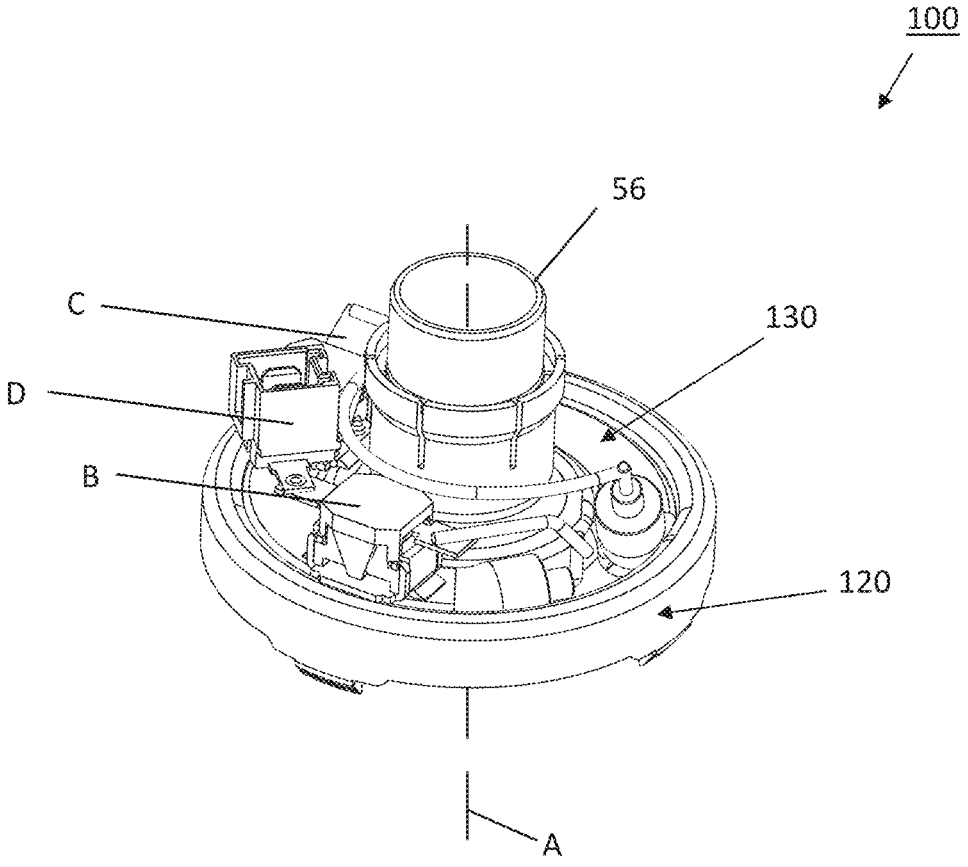
FIG. 2: is a perspective view to a heating system according FIG. 1.

As shown in FIGS. 1, 1*a* and 2, heating system 100 has a disk-like carrier unit 120 and a heating unit 130 including a heating element 132, two safety devices B, C and to connecting device D for connecting heating element 132 and safety devices B, C to a power source and a control unit.

Figure 3B:
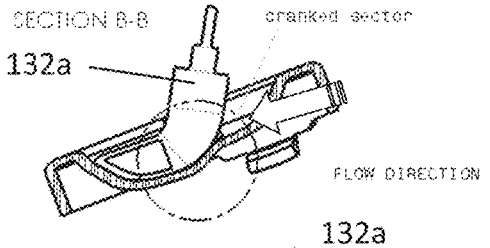
FIG. 3*b*: is a sectional view along line B-B in FIG. 3.
Figure 3A:
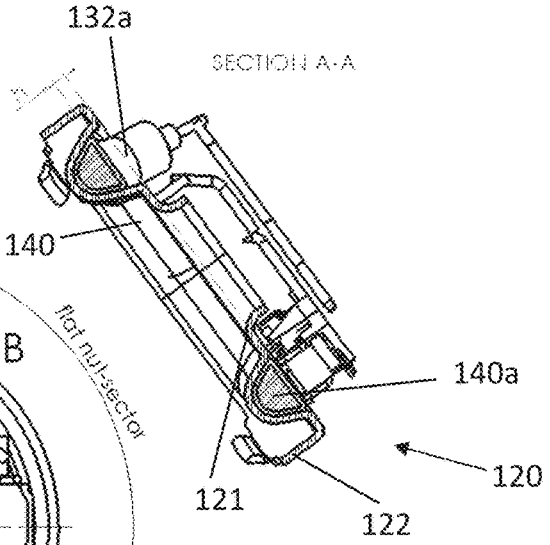
FIG. 3*a*: is a sectional view along line A-A in FIG. 3.
Figure 3:
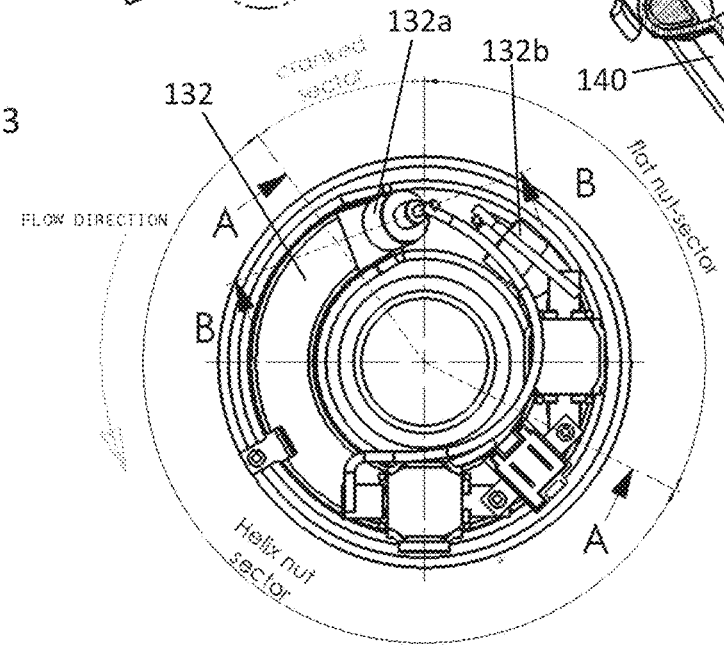
FIG. 3: is a plan view to the heating system according to the present invention.

Carrier unit 120, which has the shape of a circular or round blank or disc, respectively, has a circular plane portion 121 surrounded by a rim 122 extending approximately vertically from plane portion 121 towards pump housing 50, for surrounding and sealing the inlet opening in pump housing 50 (cf. FIGS. 3, 3*a*, 4*a*). Circular plane 121 of carrier unit 120 has a central through hole arranged coaxially to central longitudinal axis A, which forms inlet branch 56.

In circular plane portion 121, a ring-shaped groove 140 is arranged, which coaxially surrounds the central through hole in carrier unit 120 and the central longitudinal axis A. Groove 140 extends from circular plane portion 121 towards pump housing 50. In the mounted state of heated conveyor pump 1, groove 140 extends into pump housing 50.

Groove 140 is approximately V-shaped with straight legs and a preferably rounded groove base or groove bottom 140*a* with a diameter that at least approximately corresponds to the height of the cross-section of heating element 132 (cf. FIG. 3*a*). However, the diameter of the groove bottom 140*a* may also be smaller than the height of the cross-section of heating element 132. Groove 140 has a helical sector, in which the depth of groove 140, and thus, the size of its cross-section, continuously decreases in counter-clockwise direction, or in the direction of rotation of pump wheel 58, and a flat sector of constant depth (cf. FIGS. 4, 4*a*).

Heating element 132 is ring-shaped, with a diameter corresponding to the diameter of ring-shaped groove 140, and has a cranked first end 132*a* and a straight second end 132*b*. The cross-section of heating element 132 according to FIG. 3 is V-shaped and corresponds to the cross-section of groove 140.

However, it is also possible to provide a V-shaped groove with a base or bottom 140*a* having a straight portion to which the legs are coupled by smaller radii. In all cases, it is of importance that the shape of the heating element at least approximately matches the shape of the groove.

Heating element 132 is not only circularly shaped, but is also formed as a helix along central longitudinal axis A. That means the circular portion of heating element 132 extends along a circular screw line, with a difference in height between the first end 132*a* and the second end 132*b*, with the flat upper surface of second end 132*b* exceeding the flat upper surface of first end 132*a* about height h. Height h may be selected from zero up to 25 mm (cf. FIGS. 3, 3*a*, 4*a*).

Heating element 132 is arranged in groove 140 such that cranked end 132*a* is positioned in the deepest portion of the helical sector of groove 140, second end 132*b* is positioned in the flat sector, and the helical portion of heating element 132 extends through the helical sector of groove 140.

The flow channel in pump housing 50 extends along the inner surface of pump housing 50 and its size is defined by width B and its height. Due to the helical shape of groove 140 or the groove bottom 140*a* the height of the flow channel increases from a first height h1 at the beginning of the flow channel, approximately in the region of the largest depth of groove 140, to a second height h2 at its end, in the region of the flat sector.

The cross-sectional area of the flow channel affects the hydraulic efficiency of a pump. The cross-sectional area of the flow channel of heated pump 1 of the present invention is defined by its approximately constant width B and its height which increases from h1 to h2 in flow direction. Thereby, the cross-sectional area of the flow channel increases in flow direction, whereby the hydraulic efficiency of heated pump 1 may be increased.

The helical shape of heating element 132, which corresponds to the helical shape of groove 140, together with their matching cross-sectional shapes, provides a maximum contact area between heating element 132 and the contact surfaces of groove 140. Thereby, an optimal heat transfer from heating element 132 via carrier element 120 to the medium to be heated is reached.

Furthermore, due to the helical shapes of heating element 132 and groove 140, only one end 132*a* of heating element 132 has to be realized as a cranked end, whereas the second end 132*b* may be left straight. Thereby, one cranked end, which may form a possible hot spot, may be omitted. It has to be understood that the term "straight end" also includes a design in which the second end 132*b* of heating element 132 is circularly shaped, corresponding to the remaining circular portion of heating element 132. With regard to the present invention, "straight end" means that this end is not cranked.

Moreover, the cranked first end 132*a* is arranged in that portion of groove 140 with the maximum extension into pump housing 50. Accordingly, cranked end 132*a* of heating element 132, which may also be a possible hot spot, is optimally cooled by the fluid medium.

Heating element 132 may be secured in groove 140 by a suitable joining process, like welding, soldering or gluing. These joining technologies provide a safe connection between heating element 132 and carrier unit 120. Particularly, by using soldering or gluing technologies, the additional material inserted between heating element 132 and the inner surface of groove 140 may fill a possible gap therebetween, and the heat transfer from heating element 132 via carrier unit 120 to the fluid medium may be optimized. With regard to a gluing process, it has to be noted that the glue used should have specific features regarding thermal stability and heat conductivity.

The connection or joining between the heating element and the groove in the disk-shaped carrier unit should be designed in such a way that, viewed in cross-section, at least 50% of the outer circumference of the heating element is in planar contact with the boundary surface of the groove, preferably this contact should be >50%. Defects, such as air inclusions, which can form between the outer circumferential surface of the heating element in the groove and the boundary surface of the groove during a, for example, soldering process are not taken into account.

As an alternative to a joining process, it is possible to mount a heating element force fit in the groove 140 of the carrier element 120. The cross-section of the groove may be designed such that it has an approximately rectangular or trapezoid shape with side walls which exert a clamping force to a correspondingly shaped heating element.

In one case, the distance between the upper ends of the legs of the groove (at the open side) is smaller than the distance between the ends of the legs at the groove base. A heating element that has a width corresponding to the distance between the ends of the legs at the groove base, may be pressed into the groove 140 and is secured therein by a biasing force exerted thereto by the upper ends of the legs of the groove.

A possible gap between the inner surface of the groove and the heating element may then be filled with a thermal conductive paste or the like.

Carrier element 120 is preferably made of aluminium or an aluminium alloy, which provide suitable heat conductive features. However, other materials may be used, dependent on the specific application or the medium to be heated. In case of an aggressive medium, stainless steel may be used for the carrier unit. Alternatively, or additionally, carrier unit 120 may be provided with a protective coating. The protective coating may be realized in different ways. In a simple case, it may be sufficient to provide a corrosion resistant layer of plastic. In other cases, a layer of stainless steel may be roll-plated onto a carrier unit of aluminium or an aluminium alloy. Furthermore, the protective coating can be made of an inorganic material, a sol-gel material, a glass-like material etc.

Figure 5A:
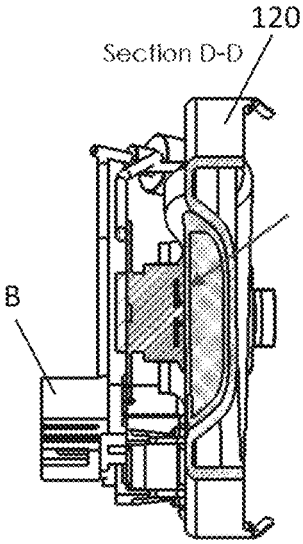
FIG. 5*a*: is a sectional view along line D-D in FIG. 5.
Figure 5B:
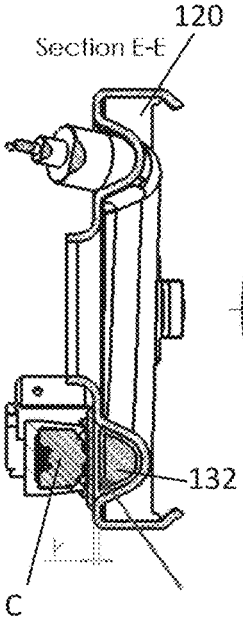
FIG. 5*b*: is a sectional view along line E-E in FIG. 5.
Figure 5:
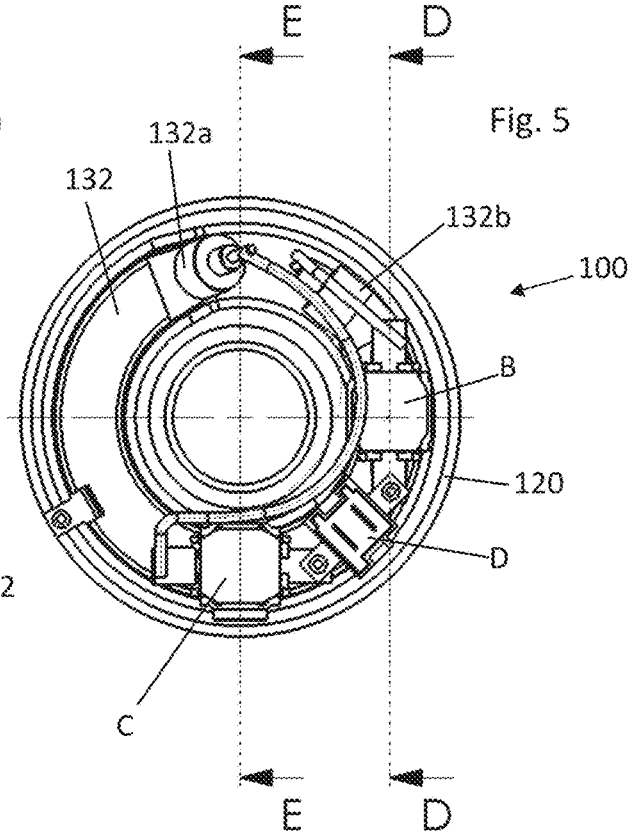
FIG. 5: is a plan view to the heating system according to FIG. 3.

Heating unit 100 is provided with safety devices B, C and a connecting device D. Safety devices B, C are arranged at respective portions of heating element 132 with safety device B in vicinity to second end 132*b* of heating element 132 (cf. FIG. 5).

Figure 5C:
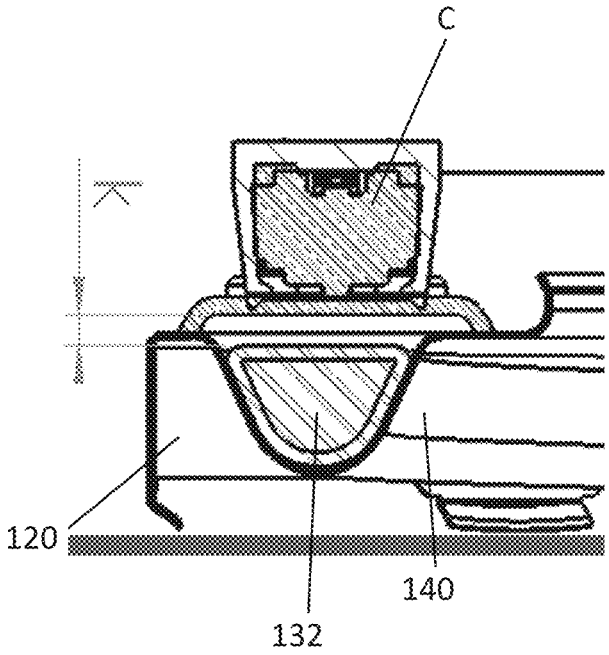
FIG. 5*c*: is a detailed view to a safety device of FIG. 5*b;*

Safety device B, which may be a temperature sensor, like an NTC thermistor, or an electromechanical switching unit is directly attached to heating element 132 in order to detect the temperature of heating element 132. Safety device C, which may be a second temperature sensor, formed by an NTC thermistor, is arranged in a central region of heating element 132 and with a distance k thereto (cf. FIGS. 5*a*, 5*b*, 5*c*). Safety device C may be arranged at a carrier element that is arranged above heating element 132 with a respective distance thereto. Distance k and the position of safety device C may be selected such that the maximum fluid medium temperature may be limited and that heating system 100 is thermally protected against overheating without activating a thermal fuse. Usually, distance k is selected between 0.3 and 3 mm, in particular 1.5 mm, and may depend on the kind of material of carrier unit 120. In case that the material has a high thermal conductivity, distance k may be less than in the case that the material of carrier unit 120 has a lower thermal conductivity.

By using safety devices B and/or C, the temperature of the medium to be heated may be adjusted such that a protection against boiling and/or drying can be achieved.

Figure 6:
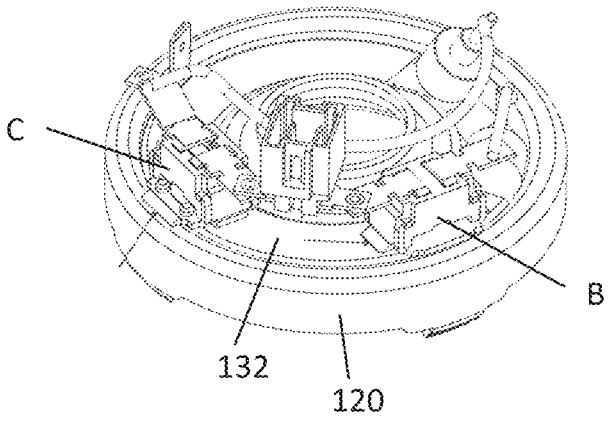
FIG. 6: is a further embodiment of a heating system according to the present invention.
Figure 7:
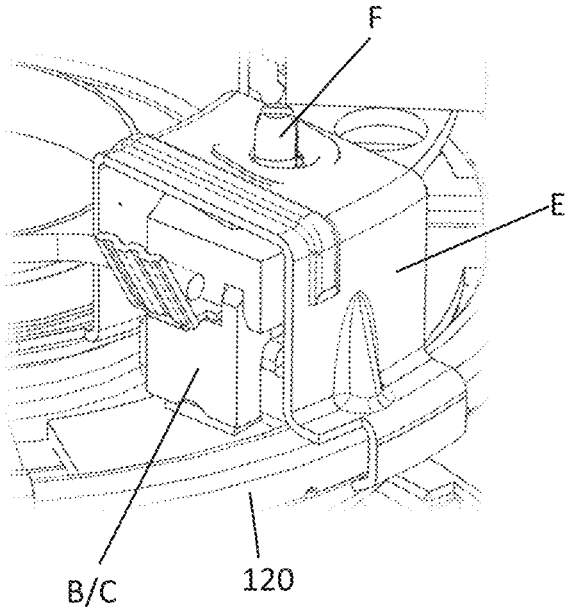
FIG. 7: is a detailed view to a further embodiment of a heating system according to the present invention.

Safety devices B, C are fixed to heating element 132 or carrier unit 120 in a suitable manner. Safety devices B, C may be soldered, welded, glued or pressed against the respective heating or carrier element by a biasing force, e.g. exerted by an elastic element, like a spring, in order to provide sufficient contact between safety devices B, C and the respective element for correctly detecting the temperature. FIG. 6 shows safety devices B, C which are welded to heating element 132 and carrier unit 120. In FIG. 7, one of safety devices B, C is secured to carrier unit 120 by a clamping element, like a retainer plate E with an elastic element F arranged between retainer plate E and safety devices B, C.

The cross-section of heating element 132 has been described as being V-shaped, and as corresponding to the cross-sectional shape of groove 140. However, the heating element, and the groove accordingly, may have any suitable shape, like a triangular, rectangular, trapezoid or circular shape. It is essential, that the shape of the heating element at least approximately matches the shape of the groove.

The described V-shape of heating element 132 is preferred, since the heating wire, which extends longitudinally through the tubular body, is arranged with an approximately equal distance to the V-shaped portion of the tubular body, which corresponds to those portions of the surface via which heat is transferred to the fluid medium to be heated. Thereby, a uniform heat transfer over the length of the heating element may be realized.

Figure 8B:
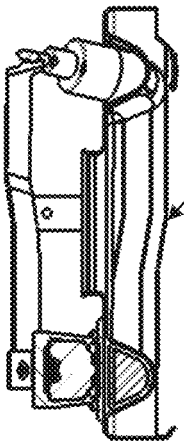
FIG. 8*b*: is a sectional view along line F-F in FIG. 8*a*.
Figure 8A:
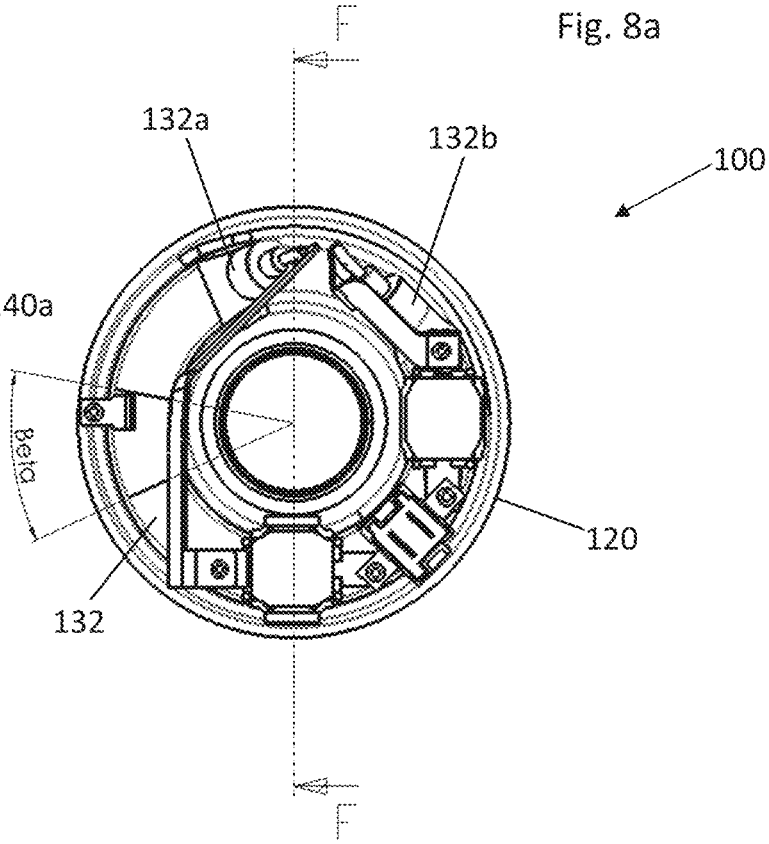
FIG. 8*a*: is a plan view to a further embodiment of a heating system according to the invention.

FIGS. 8*a* and 8*b* show another embodiment of the inventive heating system 100. Here, the groove bottom 140*a* has only one section that is inclined in relation to a horizontal plane that intersects the central longitudinal axis A vertically. As can be seen from FIG. 8*b*, the shape or course of the groove bottom 140*b* is similar to a so-called Lebus drum. Of course, several such sections can also be provided within the groove bottom 140*a*. In addition, the transitions from the surface sections of the groove bottom 140*a* and the slope(s) running parallel to the horizontal plane may be rounded or formed as sharp edges. Furthermore, it is possible that the two horizontal surface sections of the groove bottom 140*a* itself have an inclination relative to the horizontal plane.

The invention claimed is:

1. A heating system for heating a fluid medium, said heating system comprising:

a disk-like carrier unit and a heating unit;

the carrier unit having a central axis, a groove extending at least partially around the central axis and a bottom; and the heating unit having a heating element at least partially arranged in said groove of said carrier unit;

wherein at least a section of the groove bottom has an inclination referred to a plane of the carrier unit extending at least substantially normal to the central axis of the carrier unit and wherein the inclination has an inclination angle >0°; and wherein the groove bottom extends substantially helically around the central axis and wherein the heating unit is formed as a helix along the central axis.

2. The heating system according to claim 1, wherein the gradient of the inclination of the groove bottom is at least partially continuous.

3. The heating system according to claim 1, wherein the gradient of the inclination of the groove bottom is at least partially discontinuous.

4. The heating system according to claim 1, wherein the bottom of the groove has at least two sections the inclination angles of which are unequal.

5. The heating system according to claim 1, wherein the bottom of the groove has at least two sections the inclination angles of which are equal.

6. The heating system according to claim 5, wherein the sections follow one after the other.

7. The heating system according to claim 5, wherein the sections are separated from each other.

8. The heating system according to claim 4, wherein the sections follow one after the other.

9. The heating system according to claim 4, wherein the sections are separated from each other.

10. The heating system according to any of claim 1, wherein the heating element has at least one cranked end.

11. The heating system according to claim 10, wherein the heating element has two cranked ends wherein the degree of offsetting of the cranked ends is different.

12. The heating system according to claim 10, characterized in that wherein an inwards direction is defined as the extension direction of the groove from the carrier unit projected onto the central axis and the at least partially part-circularly shaped tubular heating element is arranged in the groove with the cranked end positioned at the largest extension of the groove in the inwards direction.

13. The heating system according to claim 1, wherein a size of the cross-section of the groove continuously decreases at least partially, wherein the at least partially part-circularly shaped tubular heating element is arranged in the groove with the cranked end positioned at least approximately at the largest cross-section of the groove.

14. The heating system according to claim 1, wherein the carrier unit is provided with a protective coating, at least at that surface facing away from the heating element.

15. The heating system according to claim 1, wherein the carrier unit comprises or consists of a heat conducting material.

16. A heated conveyor pump for conveying and heating a fluid medium, said pump comprising:

a drive unit, a pump housing and a heating system, wherein the heating system is defined according to claim 1.

* * * * *